US008800425B2

(12) United States Patent
Koskimäki et al.

(10) Patent No.: US 8,800,425 B2
(45) Date of Patent: Aug. 12, 2014

(54) PERCUSSION DEVICE

(75) Inventors: Antti Koskimäki, Tampere (FI); Ari Kotala, Tampere (FI)

(73) Assignee: Sandvik Mining and Construction Oy, Tampere (FI)

( * ) Notice: Subject to any disclaimer, the term of this patent is extended or adjusted under 35 U.S.C. 154(b) by 1015 days.

(21) Appl. No.: 12/520,587

(22) PCT Filed: Dec. 19, 2007

(86) PCT No.: PCT/FI2007/050703

§ 371 (c)(1),
(2), (4) Date: Jun. 22, 2009

(87) PCT Pub. No.: WO2008/074920

PCT Pub. Date: Jun. 26, 2008

(65) Prior Publication Data

US 2010/0059242 A1 Mar. 11, 2010

(30) Foreign Application Priority Data

Dec. 21, 2006 (FI) ..... 20065834

(51) Int. Cl.
*B25D 9/20* (2006.01)

(52) U.S. Cl.
USPC ..... 91/299; 91/317

(58) Field of Classification Search
CPC ..... B25D 9/20; B25D 2209/005; F01L 17/00; F01L 25/02
USPC ..... 91/299, 317, 318
See application file for complete search history.

(56) References Cited

U.S. PATENT DOCUMENTS

| | | | | |
|---|---|---|---|---|
| 2,259,379 | A * | 10/1941 | Herzbruch | 91/299 |
| 4,028,995 | A | 6/1977 | Salmi et al. | |
| 4,474,248 | A | 10/1984 | Musso | |
| 4,624,325 | A | 11/1986 | Steiner | |
| 4,635,531 | A | 1/1987 | Rode | |
| 6,877,569 | B2 | 4/2005 | Koskimäki | |
| 2003/0006052 | A1 | 1/2003 | Campbell, Jr. | |

FOREIGN PATENT DOCUMENTS

| | | |
|---|---|---|
| AU | 729250 | 4/1997 |
| CA | 2 278 036 | 1/2000 |
| DE | 16 02 006 | 5/1970 |
| DE | 199 35 890 | 4/2000 |
| EP | 1 399 298 | 8/2008 |
| FR | 2 268 603 | 11/1975 |

OTHER PUBLICATIONS

EPO: Communication—Extended European Search Report with Supplementary European Search Report for European Patent Application No. 07 858 354.9—Issued on Feb. 26, 2013.

* cited by examiner

*Primary Examiner* — F. Daniel Lopez
(74) *Attorney, Agent, or Firm* — Morgan, Lewis & Bockius LLP

(57) ABSTRACT

The invention relates to a percussion device having a body and a percussion piston moving therein, pressure fluid spaces in the rear and front ends of the percussion piston and pressure fluid channels for feeding pressure fluid into the percussion device. The percussion piston and the control valve comprise surfaces, which, when aligned, substantially close the pressure fluid flow from the pressure fluid space locating behind the percussion piston in front of the control valve, whereby the produced pressure displaces the control valve to another position.

13 Claims, 4 Drawing Sheets

Prior art

PERCUSSION DEVICE

RELATED APPLICATION DATA

This application is a §371 National Stage Application of PCT International Application No. PCT/FI2007/050703 filed Dec. 19, 2007, which claims priority under 35 U.S.C. §119 and/or §365 to Finnish Application No. 20065834, filed Dec. 21, 2006.

BACKGROUND OF THE INVENTION

The invention relates to a percussion device comprising a body and therein a percussion piston that moves longitudinally in a reciprocating manner by action of pressure fluid, in the body a first and a second pressure fluid space in the rear end and correspondingly in the front end of the percussion piston and a control valve that is substantially sleeve-like, locating around the rear end of the percussion piston and movably mounted in the longitudinal direction of the percussion piston, as well as pressure fluid channels for feeding pressurized pressure fluid in and out of the percussion device.

In pressure-fluid-operated percussion devices the reciprocating percussion movement of the percussion piston is controlled by a control valve that controls pressure fluid feed onto pressure surfaces of the percussion piston. In a known solution the control valve is located axially to the percussion piston in the rear end of the percussion piston. The position of the control valve in various stages of percussion is controlled by the position of the percussion piston with respect to the percussion device, and consequently as the percussion piston approaches its rear position it causes a change in the position of the control valve, typically by means of external pressure control or forced control by the effect of an increase in the pressure of the pressure fluid in a substantially closed space provided in the rear space of the piston. In the external pressure control, as the position of the percussion piston changes during the reverse stroke the percussion piston lets pressurized pressure fluid act on the control valve, which makes the control valve move from one position to another. In the forced control, a pressure rise in the rearmost pressure fluid space, in turn, results from the percussion piston compressing the pressure fluid while penetrating into the rearmost pressure fluid space, which is rendered substantially closed by the position of the percussion piston during the reverse stroke.

The external pressure control poses a problem that the valve moves slowly from one position to another. In the forced control solution, in turn, the position change of the valve is fast, but a problem is that the valve has a high final speed in both extreme positions of its movement. In addition, the pressure fluid in front of the valve flows directly into a tank, which decreases efficiency.

BRIEF DESCRIPTION OF THE INVENTION

The object of the invention is to provide a solution, in which a valve position is made to change faster and more efficiently, and correspondingly, an efficient damping cushion solution will be provided for a percussion piston and a valve.

The percussion device of the invention is characterized in that in the rear end of the percussion piston there is an annular surface facing the control valve, and correspondingly, on the inner surface of the control valve there is an annular surface facing the percussion piston so that as the annular surfaces are aligned they substantially throttle the pressure fluid flow between the percussion piston and the control valve, that as the reverse stroke of the percussion piston starts the control valve is in its rearmost position and closes access of the pressure fluid to a second pressure fluid space in the rear end of the percussion piston, whereby the pressure fluid is able to flow from the second pressure fluid space via a pressure fluid channel in front of the control valve away from the percussion device, and that the percussion piston having shifted rearwardly to a predetermined position the annular surface in its rear end will be in alignment with the annular surface on the inner surface of the control valve, and consequently as the reverse stroke of the percussion piston continues the pressure in the second pressure fluid space rises decelerating the reverse stroke of the percussion piston and at the same time as pressure is acting on the surfaces on the side of the second pressure fluid space of the control valve it makes the control valve move towards the front end of the percussion device, whereby shoulders of the percussion piston and of the control valve will move apart so that the pressure fluid in the front end of the control valve will be able to flow into the second pressure fluid space in the rear end of the percussion piston and the control valve closes the pressure fluid flow through the channel out of the percussion device.

The basic idea of the invention is that the rear end of the percussion piston comprises an annular surface, and correspondingly, the interior of the valve comprises an annular surface, and as the surfaces become aligned a small clearance therebetween makes the pressure rise very fast in the rearmost cylinder space, as a result of which the valve moves fast to a second position, and correspondingly, a damping cushion is provided for the percussion piston. Further, the basic idea of the invention is that from the annular surface of the percussion piston towards the front end of the percussion piston there is a flow channel for at least the travel of the annular surface of the valve so that the annular surface of the valve having moved in front of the surface of the percussion piston there is a clearance between the valve surface and the percussion piston, through which the pressure fluid in front of the valve is able to flow from the front side of the valve to a cylinder space further back.

The solution of the invention has an advantage that the efficiency of the percussion device improves, because as a result of the control valve movement the pressure fluid in front thereof is able to move between a groove in the percussion piston and a protrusion in the control valve into the rearmost pressure fluid space of the percussion device, i.e. into a work space, and it is not made to flow into the pressure fluid container. Further, the valve speed is damped without a separate damping cushion.

BRIEF DESCRIPTION OF THE DRAWINGS

In the following the invention will be described in greater detail in connection with the attached drawings, in which.

DETAILED DESCRIPTION OF SOME EMBODIMENTS OF THE INVENTION

Figure 1:
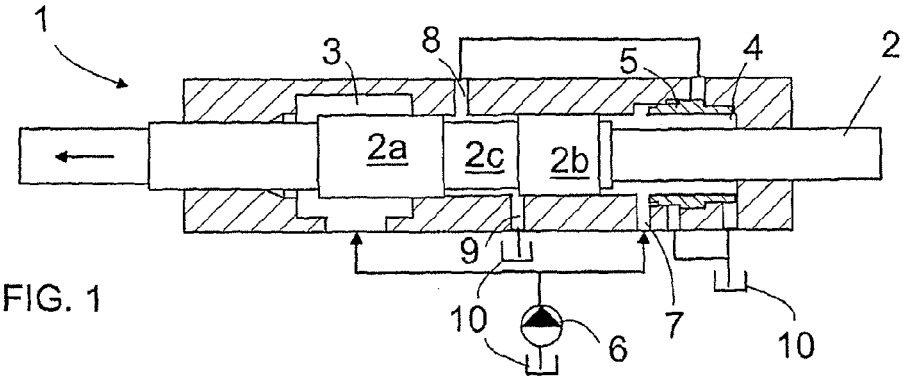
FIG. 1 is a schematic view of a prior art percussion device.

FIG. 1 shows schematically a known percussion device solution. It comprises a percussion device 1, inside which a percussion piston 2 moves in a reciprocating manner. The percussion piston 2 comprises shoulders 2*a* and 2*b* and between them there is an annular groove 2*c*, by means of which the operation of the percussion device is controlled. In the front end of the percussion device there is a first pressure fluid space 3 and in the rear end a second pressure fluid space 4. Inside the pressure fluid space 4 there is a control valve 5 axially to the percussion piston. Pressure fluid is fed from a pressure fluid pump 6 to the first pressure fluid space 3 of the percussion device continuously and to the second pressure fluid space via a channel 7, controlled by the control valve 5, periodically. In the percussion device body there is also a second pressure fluid channel 8 and a third pressure fluid channel 9, which is communicating with a pressure fluid container 10. The second pressure fluid channel 8 is connected to the control valve 5, whereby the pressure acting therein causes the control valve to move from one position to another.

In the situation shown in FIG. 1 the percussion piston 2 is moving forwardly in the direction of the arrow. The control valve 5 is in its rearmost position, i.e. on the right in the situation depicted in FIG. 1, and the pressure fluid is able to flow from the pressure fluid pump 6 via the channel 7 to the second, i.e. the rearmost, pressure fluid space 4, pushing the percussion piston forwardly. Substantially zero pressure prevails in the channel 8, because the channel 8 is connected via the groove 2*c* to the pressure fluid container 10. At the same time the control valve 5 is also substantially subjected to zero pressure, and consequently the control valve remains immobile.

As the percussion piston moves forwardly in the travel direction, the shoulder 2*b* closes the channel 9 and thus separates the space formed by means of the groove 2*c* from the pressure fluid container 10. As the percussion piston moves further forwardly, a connection is provided from the first pressure fluid space 3 through the groove 2*c* to the channel 8, whereby the pressure in the pressure fluid also acts on the control valve 5 and makes it change the position.

FIGS. 2*a* to 2*e* show the operation of the percussion device in accordance with the invention in different stages of movement. In these figures, like reference numerals refer to like parts as indicated in FIG. 1.

Figure 2A:
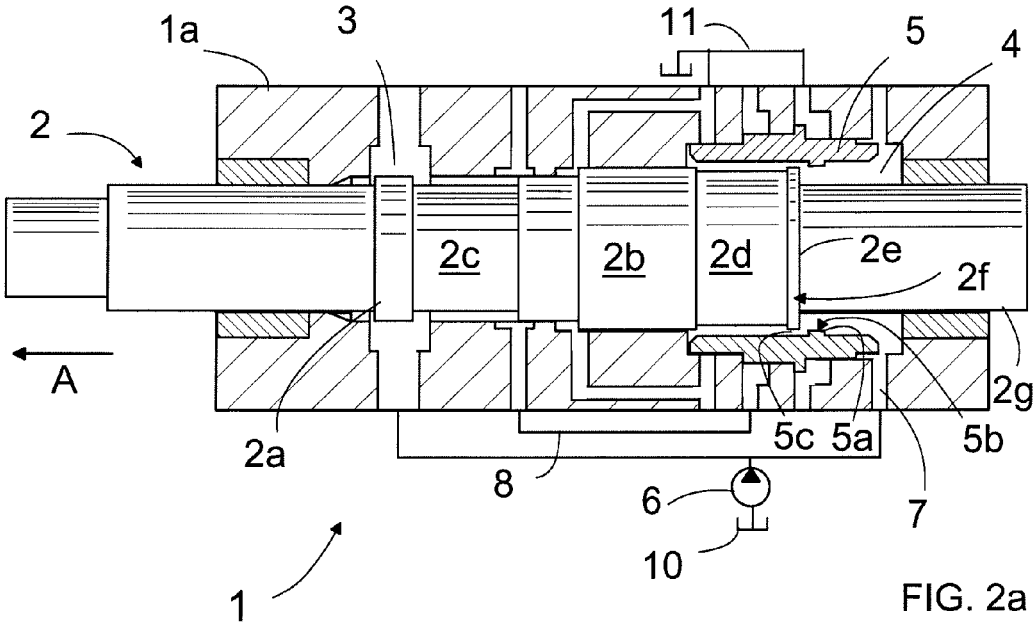
FIGS. 2*a* to 2*e* show the percussion device of the invention in various stages of percussion movement.
Figure 2B:
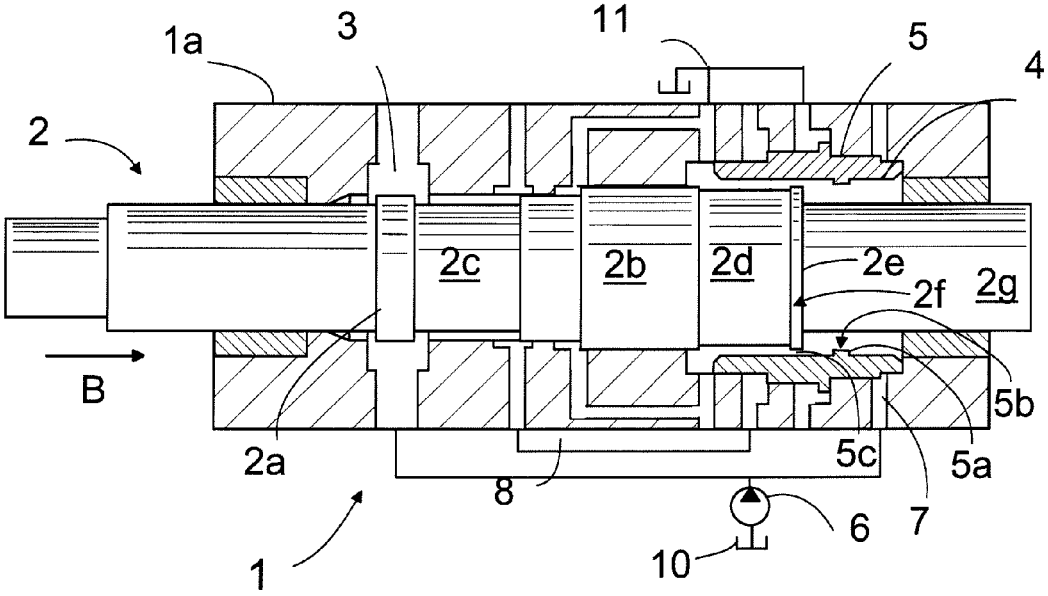

FIG. 2*a* shows a situation in which the percussion piston is in its nearly foremost position as its moves in the direction of striking, i.e. in the direction of arrow A. The control valve 5 is in its foremost position, in which the pressure of the pressure fluid acts on the back surface of the rearmost shoulder 2*b* of the percussion piston 2. At the same time, however, the pressure in the pressure fluid from the first pressure fluid space 3 is able to act on the control valve 5 via the groove 2*c* and further via the channel 8, whereby the control valve changes its position to that shown in FIG. 2*b* closing the pressure fluid access to the second pressure fluid space 4. As a result, the percussion piston 2 starts moving in the reverse direction indicated by arrow B and the pressure fluid is able to discharge between the control valve 5 and the annular groove 2*b* in the rear end of the percussion piston 2 and via the channel 11 to the pressure fluid container 10.

During the reverse stroke of the percussion piston 2 the shoulder 2*a* closes communication from the first pressure fluid space via the groove 2*c* to the channel 8 and therethrough to the control valve. Thus the pressure in the pressure fluid stops acting on the control valve 5.

The percussion piston, in the rear end behind the shoulder 2*b* thereof, comprises an annular groove, i.e. a flow channel 2*d*, in the second end of which, i.e. the rear end away from the shoulder 2*b*, there is a narrow shoulder 2*e* having an annular surface 2*f*. Further, the percussion piston may comprise a separate part 2*g* forming an extension in the rear end, but it is not necessary or relevant to the invention. The percussion piston may be without the extension 2*g* or the length and cross sectional area of the extension may vary in a manner known per se. The cross sectional area of the extension may be graded in a variety of ways without that affecting the invention in any way.

On the inner side of the control valve 5 there is a shoulder 5*a* facing the piston 2 and having an annular surface 5*b*. The inner diameter of the control valve 5 from the shoulder 5*a* towards the front end of the percussion device 1 is larger than the inner diameter of the shoulder 5*a* and an annular flow channel 5*c* is formed from the shoulder 5*a* up to the front end of the control valve 5.

Figure 2C:
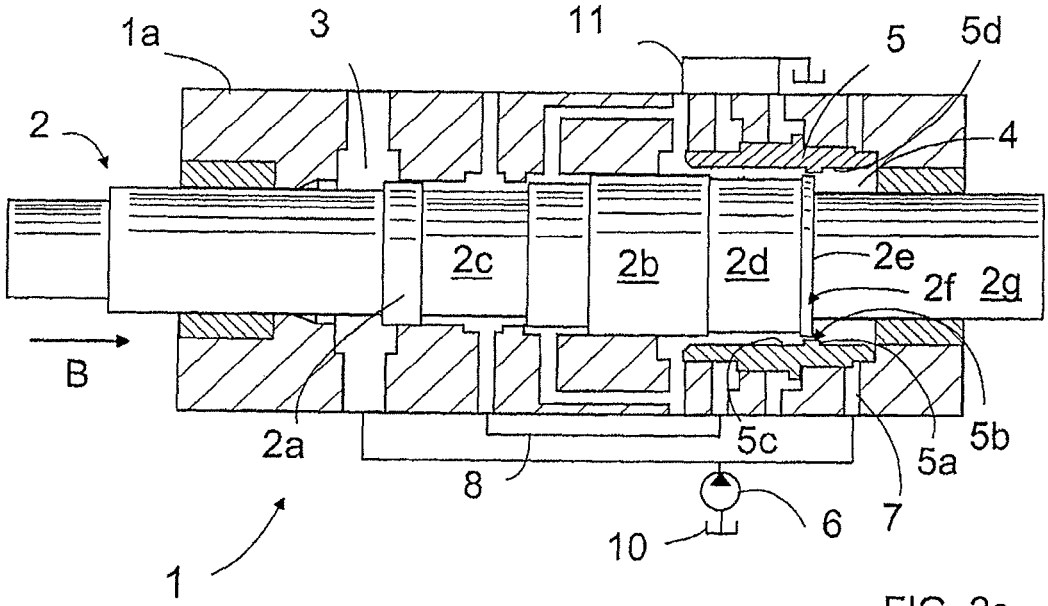

As the percussion piston 2 has reached, during its reverse stroke, the position shown in FIG. 2*c*, in which the shoulder edges and thus the annular surfaces 2*f* and 5*b* are aligned, there is only a small clearance between the shoulders 2*e* and 5*a*, which provides a throttle for the pressure fluid flow. As a result, the pressure fluid flow from the second pressure fluid space, between the percussion piston 2 and the control valve 5, via the channel 9 to the pressure fluid container 10 will be considerably reduced or substantially prevented. So, as the percussion piston protrudes into the rearmost, i.e. the second pressure fluid space 4, a sudden high pressure is created therein. Thus, there is also created a damping cushion filled with pressure fluid, which dampens the reverse motion of the percussion piston 2, as high pressure, when acting on the surfaces of the control valve 5 facing the second pressure fluid space 4, makes the control valve 5 move fast to the front position, i.e. the position shown in FIG. 2*a*.

Figure 2E:
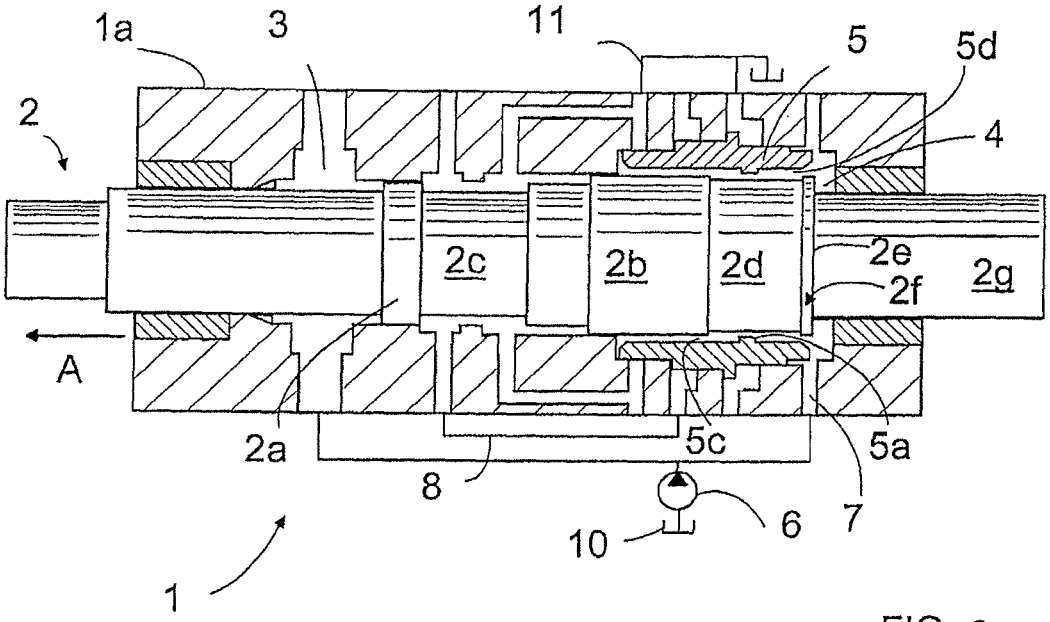
Figure 2D:
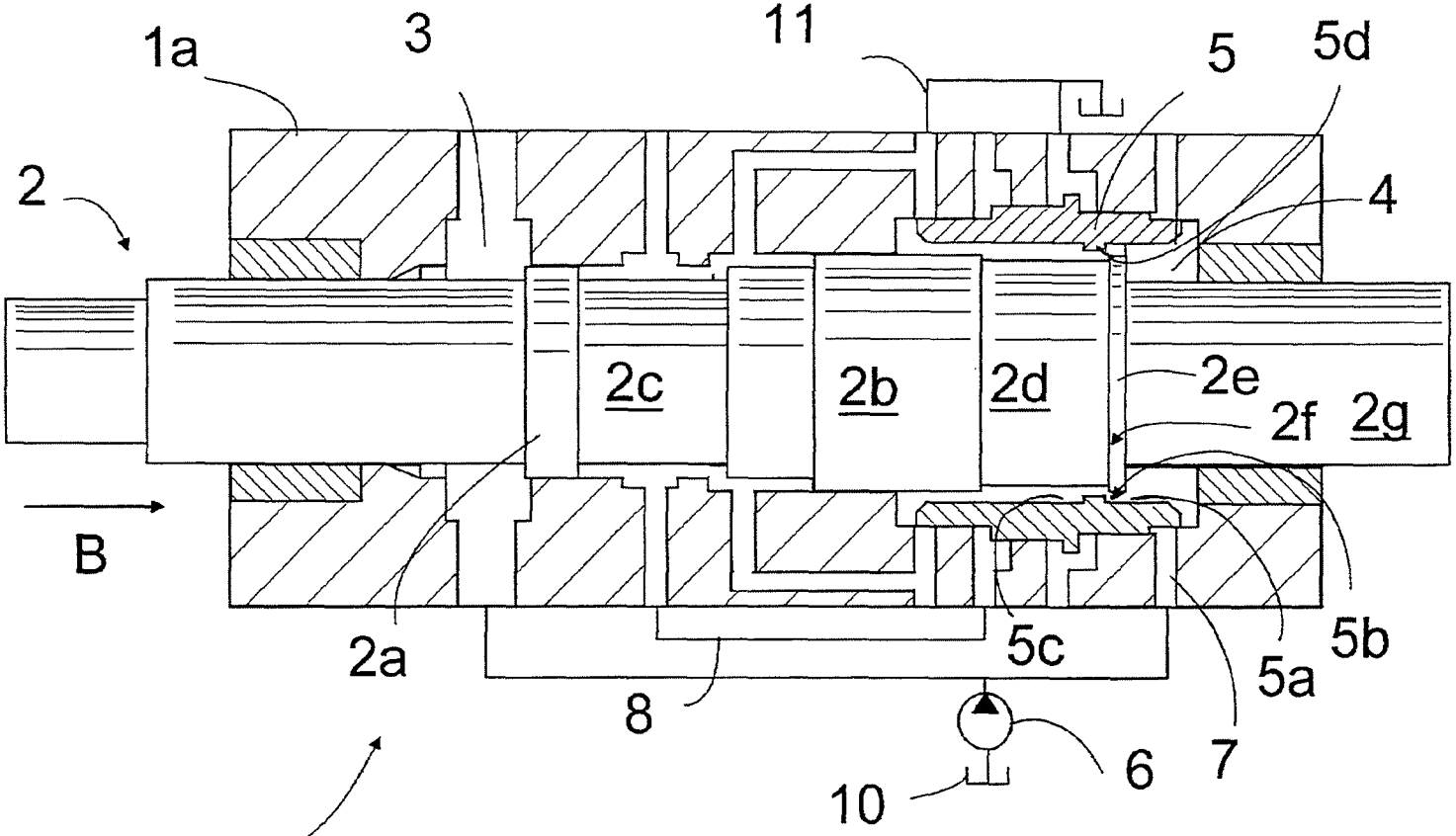

FIG. 2*d* shows the annular surfaces 2*f* and 5*b* of the shoulders 2*e* and 5*a* having passed one another and the pressure fluid is able to flow between the front end of the control valve and the second pressure fluid space 4 via the flow channel 5*c* and the flow channel 2*d*, respectively. If the protrusion 5*a* is, as shown in FIGS. 2*a* to 2*e*, between the ends of the control valve 5, there has to be a flow channel also in the rear part of the control valve 5, i.e. from the shoulder 5*a* to the rear end of the control valve 5. By way of example, in this case it is formed in such a manner that the inner diameter of the control valve 5 extending from the shoulder 5*a* towards the rear end of the percussion device 1 is larger than the inner diameter of the shoulder 5*a*, whereby an annular flow channel 5*d* is formed from the shoulder 5*a* to the rear end of the control valve 5. When the shoulder 5*a* is in the rear end of the control valve 5, no separate flow channel will be needed, naturally.

In the situation shown in FIG. 2*e*, the percussion piston 2 is in its rearmost position and the control valve 5 has moved to its foremost position. In this situation the percussion piston 2 starts moving again forwardly in the direction of arrow A and the working cycle continues in the above described manner.

Figure 3A:
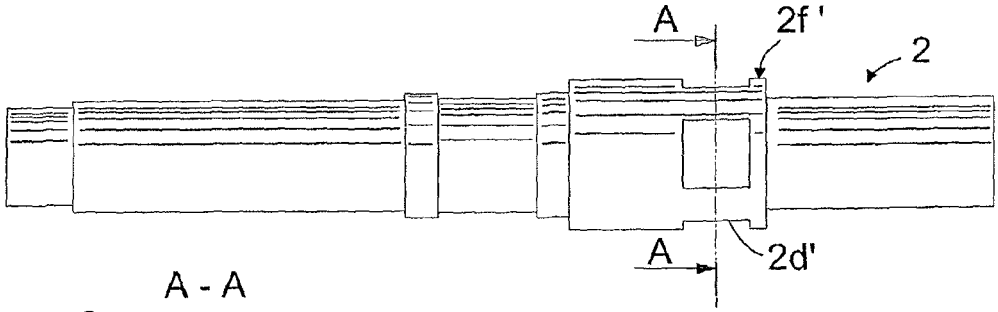
FIGS. 3*a* and 3*b* show an embodiment of a percussion piston applicable for implementing the invention.
Figure 3B:
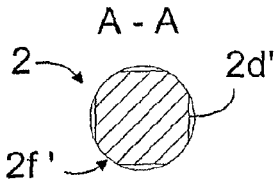

FIGS. 3*a* and 3*b* show an alternative embodiment of the percussion piston, which is applicable for use in accordance with the invention. In this embodiment there is not an annular groove extending around the whole percussion piston between the shoulder 2*b* and the annular surface 2*f*, but by way of example, it is provided with four or more longitudinal grooves that constitute flow channels 2*d*' and via which the pressure fluid is able to flow between the protrusion 5*a* of the control valve 5 and the percussion piston 2. Otherwise the structure and operation of the percussion piston are similar to those shown in FIGS. 2*a* to 2*d*. FIG. 3*b* depicts the form of the grooves 2*d*' as a cross section A-A of the percussion piston.

Figure 4A:
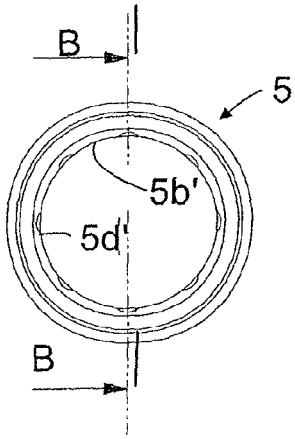
FIGS. 4*a* and 4*b* show an embodiment of a control valve applicable for implementing the invention.
Figure 4B:
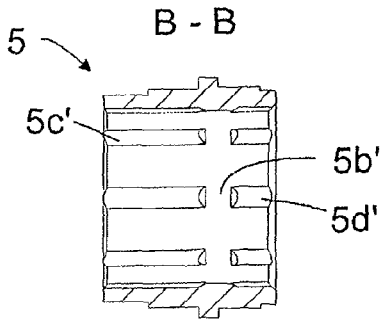

FIGS. 4*a* and 4*b*, in turn, show an embodiment of the control valve, which is also applicable to the percussion device of the invention. In this embodiment on the inner surface of the control valve 5 there are provided longitudinal grooves that constitute flow channels 5*c*', via which the pressure fluid is able to flow. On the inner surface of the control valve 5 there is a continuous, annular surface 5*b*', which cooperates with the annular surface 2*f* or 2*f*' of the percussion piston 2. It also comprises longitudinal grooves that constitute flow channels 5*d*' rearwardly from the annular surface 5*b*'.

The invention is described in the above specification and the drawings only by way of example and it is by no means restricted thereto. From the viewpoint of the invention it is substantial that the percussion piston and the control valve comprise narrow, annular surfaces, preferably shoulders, which when in alignment form a nearly closed space providing a high pressure in the pressure fluid behind the percussion piston and, on the other hand, the surfaces, such as the shoulders, having passed one another, the flow channels, such as the annular grooves, allow the pressure fluid displaced by the control valve to flow into the pressure fluid space behind the percussion piston.

The invention claimed is:

1. A percussion device comprising a body and therein a percussion piston that moves along a longitudinal axis in a reciprocating manner by action of pressure fluid, wherein the body includes a first and a second pressure fluid space located toward a front end and toward a rear end of the percussion piston, respectively, each pressure fluid space formed at least in part by a portion of a surface of the percussion piston, a control valve that is substantially sleeve-like, located in the second pressure fluid space and movably mounted in a direction of the longitudinal axis of the percussion piston, and a plurality of pressure fluid channels for moving pressurized pressure fluid in and out of the pressure fluid spaces of the percussion device, wherein toward the rear end of the percussion piston there is a radially protruding annular surface facing the control valve and on the inner surface of the control valve there is a radially protruding annular surface facing the percussion piston so that as the respective radially protruding annular surfaces are aligned they substantially throttle the pressure fluid flow between a first side and a second side of the aligned annular surfaces, the percussion device configured for the radially protruding annular surface of the piston to shift rearward and forward of the radially protruding annular surface of the control valve, wherein, as a reverse stroke of the percussion piston starts, the control valve is in a rearmost position and closes access of the pressure fluid to the second pressure fluid space from a first of the pressure fluid channels and opens access to a second of the pressure fluid channels, and wherein, the percussion piston having shifted rearwardly to a predetermined position, the radially protruding annular surface of the percussion piston will be in alignment with the radially protruding annular surface on the inner surface of the control valve, and consequently as the reverse stroke of the percussion piston continues, the pressure in the second pressure fluid space rises decelerating the reverse stroke of the percussion piston and at the same time pressure is acting on the surfaces of the control valve on the side of the second pressure fluid space to move the control valve towards the front end of the percussion device, whereby the radially protruding annular surfaces of the percussion piston and of the control valve will move apart and reduce the throttling of the pressure fluid flow between the first side and the second side of the annular surfaces and whereby the control valve closes access of the pressure fluid to the second of the pressure fluid channels and opens access of the pressure fluid to the second pressure fluid space from the first of the pressure fluid channels.

2. The percussion device of claim 1, wherein the percussion piston and the control valve include circumferential surfaces not part of the radially protruding annular surfaces, and wherein each circumferential surface comprises at least two longitudinal ridges between each of which there is at least one longitudinal groove, which are mutually aligned flow channels through which the pressure fluid is able to flow.

3. The percussion device of claim 1, wherein on an inner surface of the control valve not part of the radially protruding annular surface there is at least two longitudinal ridges between each of which there is at least one flow channel that extends from the radially protruding annular surface towards the front end of the percussion device.

4. The percussion device of claim 1, wherein on a surface of the control valve from the radially protruding annular surface of the control valve towards the rear end of the control valve there is at least one flow channel formed by at least two longitudinal ridges on the surface of the control valve.

5. The percussion device of claim 1, wherein the percussion piston and the control valve comprise, on surfaces located from the radially protruding annular surfaces towards the front end of the percussion device, mutually aligned flow channels through which the pressure fluid is able to flow between the percussion piston and the control valve.

6. The percussion device of claim 1, wherein at least one of the percussion piston and the control valve has a surface not part of the radially protruding annular surface that comprises at least two longitudinal grooves, which are mutually aligned flow channels through which the pressure fluid is able to flow.

7. The percussion device of claim 1, wherein the first of the pressure fluid channels is located in the second pressure fluid space axially rearward of the second of the pressure fluid channels.

8. The percussion device of claim 7, wherein the first of the pressure fluid channels is in fluid communication with a fluid pump to pressurize the pressure fluid and the second of the pressure fluid channels is in fluid communication with a pressure fluid container.

9. A percussion device comprising a body and therein a percussion piston that moves along a longitudinal axis in a reciprocating manner by action of pressure fluid, wherein the body includes a first and a second pressure fluid space located toward a front end and toward a rear end of the percussion piston, respectively, each pressure fluid space formed at least in part by a portion of a surface of the percussion piston, a control valve that is substantially sleeve-like, located in the second pressure fluid space and movably mounted in a direction of the longitudinal axis of the percussion piston, and a plurality of pressure fluid channels for moving pressurized pressure fluid in and out of the pressure fluid spaces of the percussion device, wherein toward the rear end of the percussion piston there is a radially protruding annular surface facing the control valve and on the inner surface of the control valve there is a radially protruding annular surface facing the percussion piston so that as the respective radially protruding annular surfaces are aligned they substantially throttle the pressure fluid flow between a first side and a second side of the aligned annular surfaces, wherein, as a reverse stroke of the percussion piston starts, the control valve is in a rearmost position and closes access of the pressure fluid to the second pressure fluid space from a first of the pressure fluid channels and opens access to a second of the pressure fluid channels, wherein, the percussion piston having shifted rearwardly to a predetermined position, the radially protruding annular surface of the percussion piston will be in alignment with the radially protruding annular surface on the inner surface of the control valve, and consequently as the reverse stroke of the percussion piston continues, the pressure in the second pressure fluid space rises decelerating the reverse stroke of the percussion piston and at the same time pressure is acting on the surfaces of the control valve on the side of the second pressure fluid space to move the control valve towards the front end of the percussion device, whereby the radially protruding annular surfaces of the percussion piston and of the control valve will move apart and reduce the throttling of the pressure fluid flow between the first side and the second side of the annular surfaces and whereby the control valve closes access of the pressure fluid to the second of the pressure fluid channels and opens access of the pressure fluid to the second pressure fluid space from the first of the pressure fluid channels, and wherein the percussion piston and the control valve include circumferential surfaces not part of the radially protruding annular surfaces, and wherein each circumferential surface comprises at least two longitudinal ridges between each of which there is at least one longitudinal groove, which are mutually aligned flow channels through which the pressure fluid is able to flow.

10. A percussion device comprising a body and therein a percussion piston that moves along a longitudinal axis in a reciprocating manner by action of pressure fluid, wherein the body includes a first and a second pressure fluid space located toward a front end and toward a rear end of the percussion piston, respectively, each pressure fluid space formed at least in part by a portion of a surface of the percussion piston, a control valve that is substantially sleeve-like, located in the second pressure fluid space and movably mounted in a direction of the longitudinal axis of the percussion piston, and a plurality of pressure fluid channels for moving pressurized pressure fluid in and out of the pressure fluid spaces of the percussion device, wherein toward the rear end of the percussion piston there is a radially protruding annular surface facing the control valve and on the inner surface of the control valve there is a radially protruding annular surface facing the percussion piston so that as the respective radially protruding annular surfaces are aligned they substantially throttle the pressure fluid flow between a first side and a second side of the aligned annular surfaces, wherein, as a reverse stroke of the percussion piston starts, the control valve is in a rearmost position and closes access of the pressure fluid to the second pressure fluid space from a first of the pressure fluid channels and opens access to a second of the pressure fluid channels, wherein, the percussion piston having shifted rearwardly to a predetermined position, the radially protruding annular surface of the percussion piston will be in alignment with the radially protruding annular surface on the inner surface of the control valve, and consequently as the reverse stroke of the percussion piston continues, the pressure in the second pressure fluid space rises decelerating the reverse stroke of the percussion piston and at the same time pressure is acting on the surfaces of the control valve on the side of the second pressure fluid space to move the control valve towards the front end of the percussion device, whereby the radially protruding annular surfaces of the percussion piston and of the control valve will move apart and reduce the throttling of the pressure fluid flow between the first side and the second side of the annular surfaces and whereby the control valve closes access of the pressure fluid to the second of the pressure fluid channels and opens access of the pressure fluid to the second pressure fluid space from the first of the pressure fluid channels, and wherein on an inner surface of the control valve not part of the radially protruding annular surface there is at least two longitudinal ridges between each of which there is at least one flow channel that extends from the radially protruding annular surface towards the front end of the percussion device.

11. A percussion device comprising a body and therein a percussion piston that moves along a longitudinal axis in a reciprocating manner by action of pressure fluid, wherein the body includes a first and a second pressure fluid space located toward a front end and toward a rear end of the percussion piston, respectively, each pressure fluid space formed at least in part by a portion of a surface of the percussion piston, a control valve that is substantially sleeve-like, located in the second pressure fluid space and movably mounted in a direction of the longitudinal axis of the percussion piston, and a plurality of pressure fluid channels for moving pressurized pressure fluid in and out of the pressure fluid spaces of the percussion device, wherein toward the rear end of the percussion piston there is a radially protruding annular surface facing the control valve and on the inner surface of the control valve there is a radially protruding annular surface facing the percussion piston so that as the respective radially protruding annular surfaces are aligned they substantially throttle the pressure fluid flow between a first side and a second side of the aligned annular surfaces, wherein, as a reverse stroke of the percussion piston starts, the control valve is in a rearmost position and closes access of the pressure fluid to the second pressure fluid space from a first of the pressure fluid channels and opens access to a second of the pressure fluid channels, wherein, the percussion piston having shifted rearwardly to a predetermined position, the radially protruding annular surface of the percussion piston will be in alignment with the radially protruding annular surface on the inner surface of the control valve, and consequently as the reverse stroke of the percussion piston continues, the pressure in the second pressure fluid space rises decelerating the reverse stroke of the percussion piston and at the same time pressure is acting on the surfaces of the control valve on the side of the second pressure fluid space to move the control valve towards the front end of the percussion device, whereby the radially protruding annular surfaces of the percussion piston and of the control valve will move apart and reduce the throttling of the pressure fluid flow between the first side and the second side of the annular surfaces and whereby the control valve closes access of the pressure fluid to the second of the pressure fluid channels and opens access of the pressure fluid to the second pressure fluid space from the first of the pressure fluid channels, and wherein on a surface of the control valve from the radially protruding annular surface of the control valve towards the rear end of the control valve there is at least one flow channel formed by at least two longitudinal ridges on the surface of the control valve.

12. A percussion device comprising a body and therein a percussion piston that moves along a longitudinal axis in a reciprocating manner by action of pressure fluid, wherein the body includes a first and a second pressure fluid space located toward a front end and toward a rear end of the percussion piston, respectively, each pressure fluid space formed at least in part by a portion of a surface of the percussion piston, a control valve that is substantially sleeve-like, located in the second pressure fluid space and movably mounted in a direction of the longitudinal axis of the percussion piston, and a plurality of pressure fluid channels for moving pressurized pressure fluid in and out of the pressure fluid spaces of the percussion device, wherein toward the rear end of the percussion piston there is a radially protruding annular surface facing the control valve and on the inner surface of the control valve there is a radially protruding annular surface facing the percussion piston so that as the respective radially protruding annular surfaces are aligned they substantially throttle the pressure fluid flow between a first side and a second side of the aligned annular surfaces, wherein, as a reverse stroke of the percussion piston starts, the control valve is in a rearmost position and closes access of the pressure fluid to the second pressure fluid space from a first of the pressure fluid channels and opens access to a second of the pressure fluid channels, wherein, the percussion piston having shifted rearwardly to a predetermined position, the radially protruding annular surface of the percussion piston will be in alignment with the radially protruding annular surface on the inner surface of the control valve, and consequently as the reverse stroke of the percussion piston continues, the pressure in the second pressure fluid space rises decelerating the reverse stroke of the percussion piston and at the same time pressure is acting on the surfaces of the control valve on the side of the second pressure fluid space to move the control valve towards the front end of the percussion device, whereby the radially protruding annular surfaces of the percussion piston and of the control valve will move apart and reduce the throttling of the pressure fluid flow between the first side and the second side of the annular surfaces and whereby the control valve closes access of the pressure fluid to the second of the pressure fluid channels and opens access of the pressure fluid to the second pressure fluid space from the first of the pressure fluid channels, and wherein the percussion piston and the control valve comprise, on surfaces located from the radially protruding annular surfaces towards the front end of the percussion device, mutually aligned flow channels through which the pressure fluid is able to flow between the percussion piston and the control valve.

13. A percussion device comprising a body and therein a percussion piston that moves along a longitudinal axis in a reciprocating manner by action of pressure fluid, wherein the body includes a first and a second pressure fluid space located toward a front end and toward a rear end of the percussion piston, respectively, each pressure fluid space formed at least in part by a portion of a surface of the percussion piston, a control valve that is substantially sleeve-like, located in the second pressure fluid space and movably mounted in a direction of the longitudinal axis of the percussion piston, and a plurality of pressure fluid channels for moving pressurized pressure fluid in and out of the pressure fluid spaces of the percussion device, wherein toward the rear end of the percussion piston there is a radially protruding annular surface facing the control valve and on the inner surface of the control valve there is a radially protruding annular surface facing the percussion piston so that as the respective radially protruding annular surfaces are aligned they substantially throttle the pressure fluid flow between a first side and a second side of the aligned annular surfaces, wherein, as a reverse stroke of the percussion piston starts, the control valve is in a rearmost position and closes access of the pressure fluid to the second pressure fluid space from a first of the pressure fluid channels and opens access to a second of the pressure fluid channels, wherein, the percussion piston having shifted rearwardly to a predetermined position, the radially protruding annular surface of the percussion piston will be in alignment with the radially protruding annular surface on the inner surface of the control valve, and consequently as the reverse stroke of the percussion piston continues, the pressure in the second pressure fluid space rises decelerating the reverse stroke of the percussion piston and at the same time pressure is acting on the surfaces of the control valve on the side of the second pressure fluid space to move the control valve towards the front end of the percussion device, whereby the radially protruding annular surfaces of the percussion piston and of the control valve will move apart and reduce the throttling of the pressure fluid flow between the first side and the second side of the annular surfaces and whereby the control valve closes access of the pressure fluid to the second of the pressure fluid channels and opens access of the pressure fluid to the second pressure fluid space from the first of the pressure fluid channels, and wherein at least one of the percussion piston and the control valve has a surface not part of the radially protruding annular surface that comprises at least two longitudinal grooves, which are mutually aligned flow channels through which the pressure fluid is able to flow.

* * * * *